US007219445B2

(12) United States Patent
Stern et al.

(10) Patent No.: US 7,219,445 B2
(45) Date of Patent: May 22, 2007

(54) LOCKING MECHANISM FOR SECURING DETACHABLE SHOE UPPERS

(76) Inventors: Tracy Stern, 530 E. 76th St., 28th Floor, AHJK, New York, NY (US) 10021; Hillary Chan, 230 E. 52nd St., #PH-A, New York, NY (US) 10022

( * ) Notice: Subject to any disclaimer, the term of this patent is extended or adjusted under 35 U.S.C. 154(b) by 173 days.

(21) Appl. No.: 11/000,879

(22) Filed: Dec. 1, 2004

(65) Prior Publication Data

US 2006/0112597 A1 Jun. 1, 2006

(51) Int. Cl.
*A43B 3/12* (2006.01)

(52) U.S. Cl. ..... 36/11.5; 36/100; 36/101

(58) Field of Classification Search ..... 36/15, 36/11.5, 100, 101
See application file for complete search history.

(56) References Cited

U.S. PATENT DOCUMENTS

| | | | | | |
|---|---|---|---|---|---|
| 2,112,613 | A | * | 3/1938 | Waxelbaum | 36/11.5 |
| 2,200,080 | A | * | 5/1940 | Fein | 36/101 |
| 2,368,314 | A | * | 1/1945 | Marx | 36/11.5 |
| 2,438,711 | A | | 3/1948 | Leach et al. | 36/2.5 |
| 2,444,640 | A | | 7/1948 | Epstein | 36/2.5 |
| 2,507,120 | A | | 5/1950 | Shapiro | 36/11.5 |
| 2,519,108 | A | * | 8/1950 | Bryant et al. | 36/12 |
| 2,526,940 | A | | 10/1950 | Fello | 36/11.5 |
| 2,552,943 | A | * | 5/1951 | Danielius | 36/101 |
| 2,761,224 | A | * | 9/1956 | Gardiner | 36/11.5 |
| 2,976,623 | A | * | 3/1961 | Gallaway | 36/11.5 |
| 3,000,116 | A | * | 9/1961 | Ally | 36/101 |
| 3,016,630 | A | | 1/1962 | Twiggs, Jr. | 36/2.5 |
| 3,154,866 | A | * | 11/1964 | Laufbahn | 36/101 |
| 3,204,346 | A | * | 9/1965 | Lockard et al. | 36/101 |
| 3,436,844 | A | | 4/1969 | Sachs | 36/2.5 |
| 3,548,521 | A | | 12/1970 | Sachs | 36/2.5 |
| 3,686,779 | A | | 8/1972 | Sachs | 36/2.5 W |
| 3,890,725 | A | | 6/1975 | Lea et al. | 36/11.5 |
| 3,925,915 | A | | 12/1975 | Colli | 36/11.5 |
| 3,983,642 | A | | 10/1976 | Liao | 36/101 |

(Continued)

OTHER PUBLICATIONS

Photograph of Slide Jewelry Clasp With Biasing Retention Clip Purchased by Applicant and a Copy of the Label Showing the Mark Rio Grande.

(Continued)

*Primary Examiner*—Marie Patterson
(74) *Attorney, Agent, or Firm*—Peter S. Canelias

(57) ABSTRACT

The invention relates to an attachment mechanism and system used to accessorize, ustomize and/or personalize footwear with interchangeable uppers or straps, especially open shoes and sandals. More particularly, this invention presents a safe, secure and easy system for the attachment and detachment of shoe uppers and straps to shoes and sandals. This invention allows both the manufacturer and wearer to promote and display fashion and theme material of their own choosing, with the freedom to change the material or message without having to change footwear. The invention comprises a releasable fastener that connects a retainer, secured with the sole of the footwear, to an upper or strap. The releasable fastener is comprised of an upper and lower bar or metal loop, each loop carried on a barrel, the barrels interlocking with each other in a sliding engagement and held in the closed or engaged position by a magnet or by a biasing member.

19 Claims, 6 Drawing Sheets

U.S. PATENT DOCUMENTS

| | | | | |
|---|---|---|---|---|
| 4,103,440 | A | 8/1978 | Lawrence | 36/101 |
| 4,172,330 | A | 10/1979 | Kao | 36/11.5 |
| 4,193,214 | A | 3/1980 | Wang | 36/11.5 |
| 4,267,649 | A | 5/1981 | Smith | 36/101 |
| 4,297,798 | A | 11/1981 | Colan | 36/101 |
| 4,314,412 | A | 2/1982 | Anderson et al. | 36/100 |
| 4,363,177 | A | 12/1982 | Boros | 36/101 |
| 4,439,935 | A | 4/1984 | Kelly | 36/101 |
| 4,450,633 | A | 5/1984 | Connelly | 36/101 |
| 4,461,102 | A | 7/1984 | DeVincentis | 36/101 |
| 4,497,123 | A | 2/1985 | Ehrlich | 36/32 R |
| 4,670,996 | A | 6/1987 | Dill | 36/42 |
| 4,745,693 | A | 5/1988 | Brown | 36/101 |
| 4,839,948 | A * | 6/1989 | Boros | 24/662 |
| 4,869,000 | A | 9/1989 | York, Jr. | 36/11.5 |
| 4,887,369 | A | 12/1989 | Bailey et al. | 36/101 |
| 4,975,987 | A | 12/1990 | Teachout et al. | 2/246 |
| 5,065,531 | A | 11/1991 | Prestridge | 36/100 |
| 5,317,822 | A | 6/1994 | Johnson | 36/101 |
| 5,339,543 | A | 8/1994 | Lin | 36/101 |
| 5,465,506 | A | 11/1995 | Matis et al. | 36/11.5 |
| 5,836,090 | A * | 11/1998 | Smith | 36/7.6 |
| 5,896,684 | A * | 4/1999 | Lin | 36/101 |
| 5,991,950 | A | 11/1999 | Schenkel | 12/142 T |
| 6,349,486 | B1 * | 2/2002 | Lin | 36/101 |
| 6,418,643 | B1 | 7/2002 | Yang | 36/101 |
| 6,581,255 | B2 | 6/2003 | Kay | 24/640 |
| 2002/0078600 | A1 | 6/2002 | Berg et al. | |
| 2002/0194750 | A1 | 12/2002 | Feick | 36/101 |
| 2003/0056395 | A1 | 3/2003 | Berggren | 36/9 |
| 2003/0233772 | A1 | 12/2003 | Musial | 36/100 |
| 2004/0064976 | A1 | 4/2004 | Barteet | 36/100 |

OTHER PUBLICATIONS

Photograph of Slide Jewelry Clasp With Magnetic Retention Purchased by Applicant.

* cited by examiner

LOCKING MECHANISM FOR SECURING DETACHABLE SHOE UPPERS

BACKGROUND OF THE INVENTION

The invention relates to an attachment mechanism and system used to accessorize, customize and/or personalize footwear with interchangeable uppers or straps, especially open shoes and sandals. More particularly, this invention presents a safe, secure and easy system for the attachment and detachment of shoe uppers and straps to shoes and sandals. This invention allows both the manufacturer and wearer to promote and display fashion and theme material of their own choosing, with the freedom to change the material or message without having to change footwear or specifically without having to change the sole portion of the footwear.

Footwear tends to be relatively expensive, and is often chosen to match particular items of dress. A plethora of dress items is usually matched to a much smaller universe of available footwear, so that the footwear is chosen in basic colors and styles to coordinate with a larger universe of dress items. Footwear is also purchased according to season, degree of formality and heel height, with sandals and open-toed shoes predominating in the warmer months. Coordinating even this limited selection with wardrobe items can be difficult, and it is too expensive to purchase a new pair of shoes or sandals for each ensemble. The invention also allows a large variety of footwear to be stored in a much smaller space due to the variations available with each sole portion.

Accordingly, the desirability of footwear with convertible style has been appreciated. The prior art has propose numerous solutions, including those set out in U.S. Pat. No. 4,839,948 to Boros, which is incorporated by reference herein for all purposes. As noted in Boros, the concept of replaceable uppers is well established, wherein a sole is provided with a plurality of interchangeable uppers. Typically the sole is in a basic or neutral color, whereas the uppers are supplied in an array of colors and designs. Using a system of interchangeable uppers with a single base shoe unit, the user can have a pair of shoes that compliment a variety of apparel for reduced cost.

The prior art, however, has not provided an entirely satisfactory solution to the problem of easily attaching and detaching the uppers to the sole with a minimum of inconvenience. Other problems ensue where the sole portion or the entire shoe must be specially manufactured to accommodate the removable uppers. Further problems occur when manufacturing complex mechanisms to attach and detach the uppers, or mechanisms that require the application of special tools. Another problem is the appearance of the attachment mechanism itself. A single, distinctive piece, if perceptible on the outside of the shoe, may conflict with the uppers and the overall appearance of the footwear, defeating the one of the basic purposes of interchangeable footwear.

Accordingly, it is an object of the present invention to provide improvements in the attachment system for convertible footwear.

Another object of the invention is the provision of an improved engagement means for detachably securing the upper portion or strap to the sole of the shoe or sandal.

Another object of the invention is to provide engagement means that are readily and conveniently usable by the wearer.

Another object of the invention is the provision of engagement means that will reliably and securely affix the upper to the sole and provide sufficient load bearing capacity to offset the upward pressure of the instep of the wearer on the shoe upper.

Another object of the invention is the provision of attractive and easily matched engagement means.

Another object of the invention is the provision of a releasable fastener in the form of a separately manufactured clasp that can be used with otherwise conventional footwear.

Another object of the invention is to provide a fastening system that allows for various configurations of straps on a single sole portion.

Another object of the invention is to provide a fastening system that allows interchangeable straps for different heel heights, adapted for the specific load bearing necessity of the particular footwear configuration.

And another object of the invention is the provision of a releasable fastener that is inexpensively manufactured.

BRIEF SUMMARY OF THE INVENTION

To achieve the desired objects of the invention as set forth herein, the releasable fastening system here is adapted from clasps used in jewelry design. A detachable, interchangeable shoe upper or sandal strap has at least two contact points with the lower sole portion of the footwear. The upper or strap is secured to a retainer by means of a releasable fastener. The retainer is secured to the sole portion of the footwear, preferably by attaching one end of the retainer underneath the insole of the footwear by means of adhesive. However, the retainer may be secured by other means, including screws securing one end of the retainer to the lateral edge of the sole. The retainer itself is preferably made of a strong, durable, flexible material and is a relatively narrow and elongated strip with its lower end glued, sewn or otherwise attached to the article of footwear. The other or upper end of the retainer preferably forms a receiving loop for holding the releasable fastener. In an alternative embodiment, the retainer is secured directly to a portion of the releasable fastener, preferably by welding or soldering, and extends underneath the insole at about a ninety degree angle from the releasable fastener when in use.

The detachable shoe upper or strap typically has a left end portion and a right end portion. At least one end of the detachable shoe upper or strap is secured to an upper bar or preferably the rectangular metal loop of the releasable fastener, the upper bar preferably having a horizontal dimension sufficient to that when in the engaged position the strap will lay flat without binding or crimping. When attaching a shoe upper or strap end to the upper bar of the releasable fastener, an open end of the strap is passed through the open section of the upper bar. The strap's end is preferably looped around the upper bar and is then closed about itself to form an attachment loop. The attachment loop is preferably kept closed by sewing or stitching the end to the upper portion of the strap about the upper bar, and may be reinforced by a gluing and stitching on the underside.

A lower bar or preferably a second metal rectangular loop is secured to a retainer. The retainer is preferably formed of a flexible material such as leather or fabric, and is preferably looped around the lower bar of the releasable fastener, the lower bar preferably having a horizontal dimension sufficient to that when in the engaged position the retainer will lay flat without binding or crimping. The retainer is fastened to the sole portion of the shoe or sandal, preferably by gluing the second, distal end of the retainer underneath the insole of the sole portion. The releasable fastener itself has a substantially hollow outer barrel carrying one bar or loop, and an inner barrel carrying a second bar or loop, the diameter of the inner barrel being less than a diameter of an inner surface of the outer barrel so that the inner barrel is slidably engagable with the outer barrel and is retained in an engaged position with a securing mechanism. The securing mechanism is preferably either a magnet or a depressable biasing member. This engagement of the inner and outer barrels creates a transient interlock of the releasable fastener and the upper and lower bars, thus anchoring the shoe upper or strap with the retainer and therefore the sole portion of the shoe or sandal. With this system, a variety of shoe uppers or straps can be temporarily attached and interchanged between selected footwear.

In a more specific embodiment, the male element is a cylindrical bar and the female element is in the form of a hollow cylindrical receptacle. Attached to each is a wire loop, each preferably forming a rectangle with side bars elongated to hold the retainer on one side and the shoe upper on the other without binding or crimping, and to supply even strength to support the upward pressure of the instep on the shoe upper without inadvertently disengaging or releasing.

The receiving strip, which forms a receiving loop when it is attached to the releasable fastener, as well as the shoe upper or strap, can become a designer's accent or vanity label. When custom embroidered or printed with logos, symbols, statements, or such other ornamentation it is presented as a manufacturer's/designer's vanity or display label. Employing a label on the retaining strip would permit the system to stylize and brand the footwear with a single element and yet when in place, would also allow different, unbranded uppers or straps to be affixed without losing brand identity.

In another embodiment, the retainer can be a metal tab that is preferably the same width as a barrel of the releasable fastener to which the tab is attached. In this embodiment, the metal tab is secured directly to a barrel of the releasable fastener, and the tab portion lies between the sole portion and the insole. The tab is preferably secured to the sole portion with an adhesive, or with nails or screws preferably countersunk into the sole. And due to the weight of the wearer bearing down upon the insole and thus on the tab, further support is provided to keep the fastening system in place during use. For the comfort of the wearer, the sole portion would have a depression or countersink to accommodate the thickness of the tab so that the upper surface of the tab is substantially flush with the upper surface of the sole when in place.

In any embodiment, the invention provides a stylized releasable fastener that may coordinate with many different articles of footwear and apparel. The ease and versatility of this shoe attachment system is a system where customized or thematic expressions on footwear can be changed by the user or wearer simply by changing the upper. This is demonstrated through the unrestricted placement of the shoe upper or strap, while maintaining the same retainer attached to the sole portion, with the ability to personally select from the endless variety of uppers and straps, and different configurations of straps appropriate for soles with different heel heights, such as front, middle and back strap configurations. By using the same sized retainer across different heel heights the user can interchange straps with different height heel or sole portions. The retainers may be used on closed toe shoes and boots, and allow for different embellishments and colors on the shoe uppers. With the uncomplicated engagement means, the releasable fastener is workable even by those with limited motor skills. Other objects and advantages will be more fully apparent from the following disclosure and appended claims.

BRIEF DESCRIPTION OF THE DRAWINGS

The above-mentioned and other features and objects of this invention and the manner of obtaining them will become apparent and the invention itself will be best understood by reference to the following description of an embodiment of the invention taken in conjunction with the accompanying drawings, wherein.

DETAILED DESCRIPTION

Figure 1:
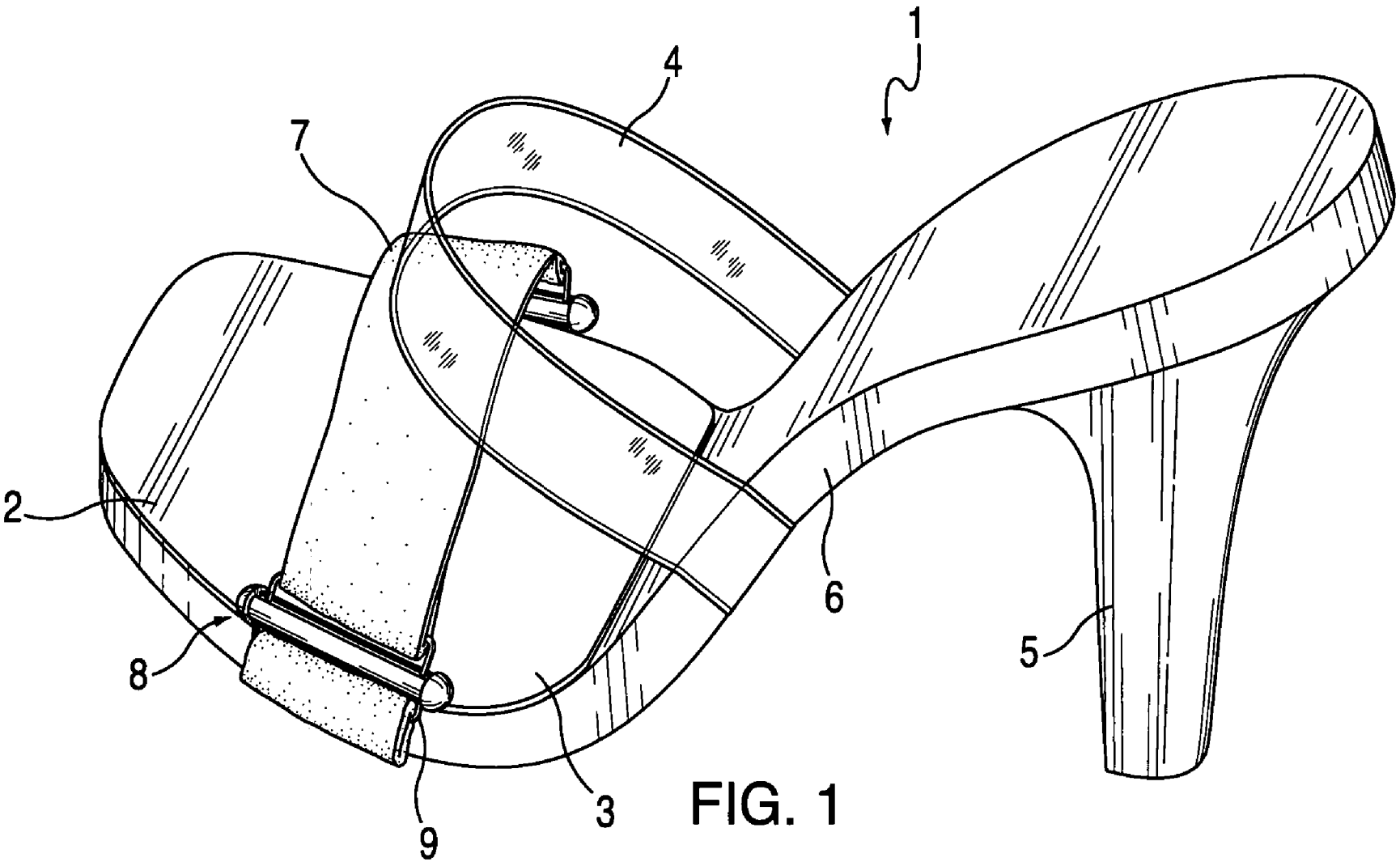
FIG. 1 is a perspective view of an article of footwear having the releasable fasteners of the present invention.

Turning now to the drawings, FIG. 1 shows an article of footwear 1 having a sole portion 2 with an insole 3 covering the upper surface of sole portion 2. The article of footwear 1 also has a flexible instep strap 4 formed of a transparent, plastic material. The instep strap is shown here for additional support due to the high heel 5 and high arch 6. The invention may be employed with a multiplicity of straps or shoe uppers, and the straps may be employed towards the toe portion of the footwear, the instep or the heel portion or used to support the ankle of the user. Strap width and length should be varied according to the anticipated user, such as for men, women and children, overall preferably between one-quarter of an inch and one and one-half of an inch in width. Preferably, for a woman's article of footwear, the strap would be between three-eights of an inch and one inch in width.

Figure 2:
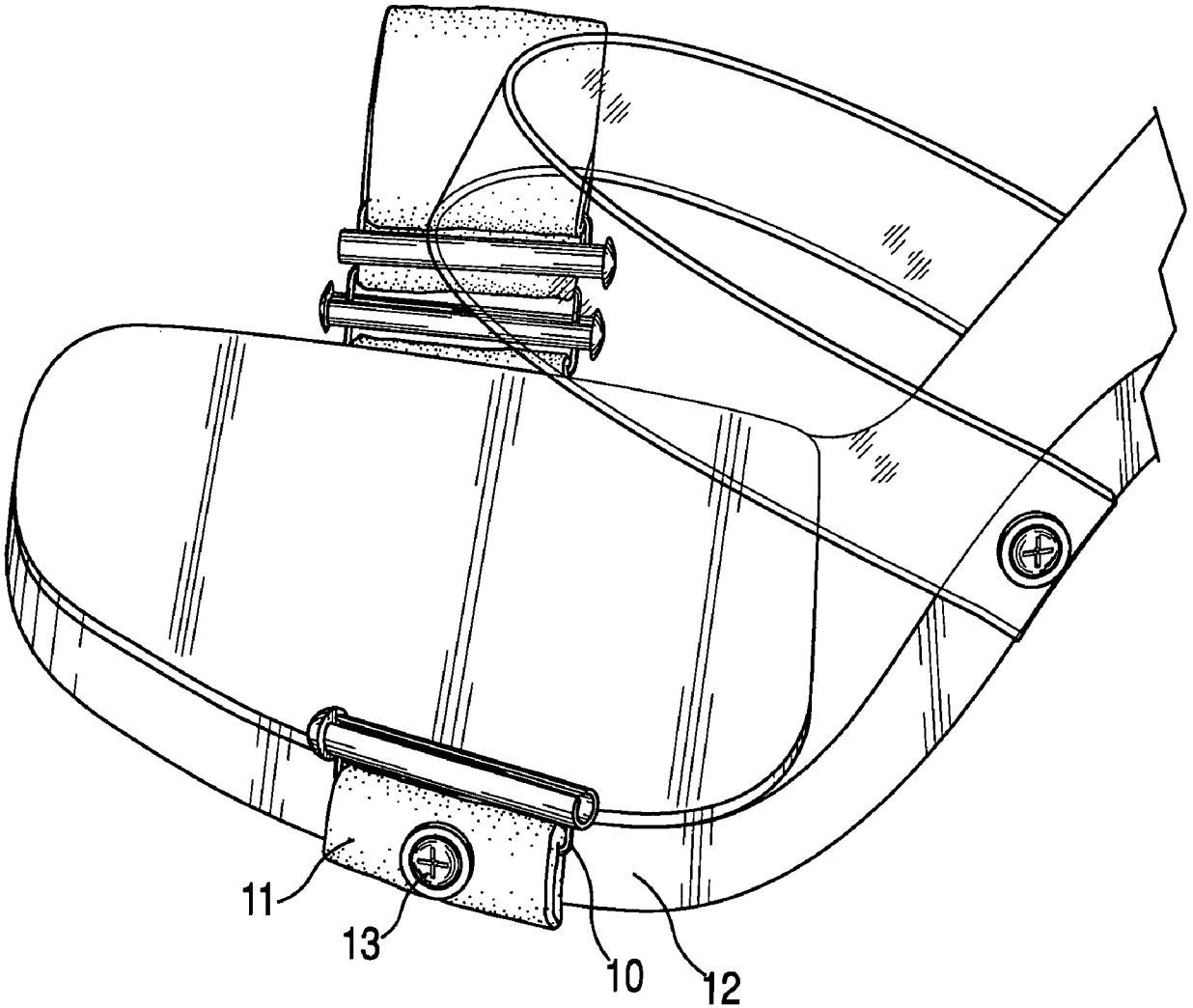
FIG. 2 is a view of an article of footwear having one end of a strap in released position.

The shoe upper, here shown as a strap 7, is secured to the releasable fastener 8 by looping the strap material about an upper bar 9 and securing the strap 7 by stitching the loop closed about the upper bar 9. The upper bar 9 forms a metal loop in a substantially rectangular shape that has a horizontal dimension 9*a* (FIG. 3) sufficient to support the strap 7 without crimping or impinging upon the strap 7. FIG. 2 shows the detail of the releasable fastener 8 in the disengaged position. A lower bar 10 carried by the releasable fastener 8 is similar in construction to the upper bar 9. Use of the terms "upper" and "lower" herein is for convenience, and does not necessarily indicate the relative positions of the upper bar 9 and lower bar 10 when in use, nor does it restrict the fastening of the shoe upper or strap to a particular bar. The retainer 11 is here shown as a flexible, glossy fabric material similar in composition to the strap 7, although different materials and labels may be employed on the retainer 11 to coordinate with a variety of shoe uppers or straps. The length of the retainer 11 may also be varied from a relatively short length whereby the retainer 11 would be barely visible to an observer, to a longer retainer which may be customized with ornamentation or manufacturer or designer labels or marks. The retainer 11 is attached to the sole portion of the article of footwear preferably by inserting beneath the insole 3 an end of the retainer 11 distal from an end looped about the lower bar 10, and securing the retainer 11 in place with adhesive. Alternatively, the retainer 11 may be secured to a lateral edge 12 of the sole portion 2 by means of one or more screws 13.

Figure 3:
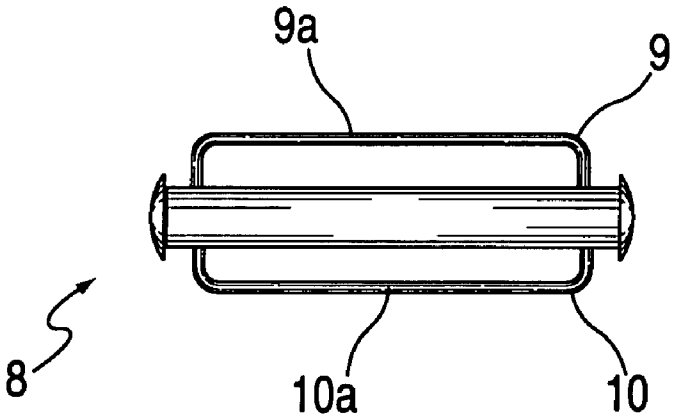
FIG. 3 is a view of a releasable fastener in the engaged position.
Figure 4:
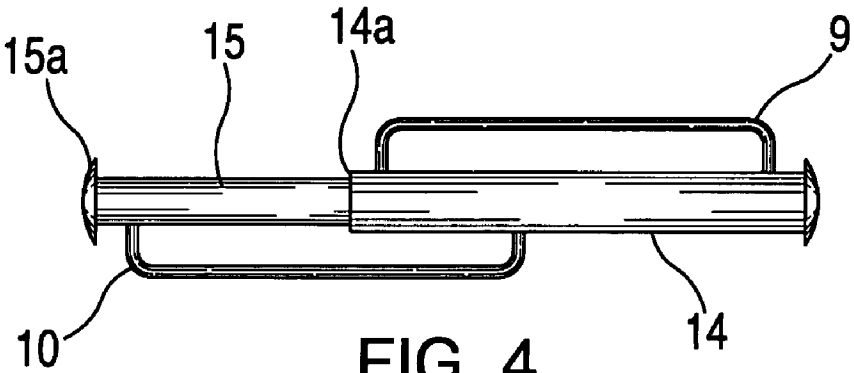
FIG. 4 is a view of a releasable fastener in a position between the engaged position and released position.
Figure 5:
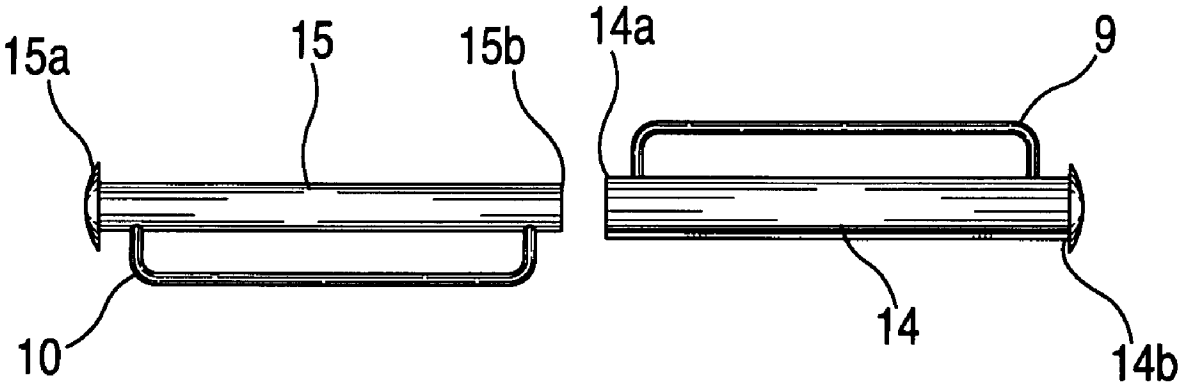
FIG. 5 is a view of a releasable fastener in a released position.

Turning to FIG. 3, a releasable fastener 8 of the claimed invention is shown in more detail. The releasable fastener 8 is preferably made in part from iron, steel or any other magnetic metal or alloy where a magnet is employed to retain the releasable fastener 8 in an engaged position. Otherwise, the releasable fastener 8 is preferably metal, and preferably made in whole or in part of a metal selected from the group consisting of titanium, steel, silver, brass and nickel. The metal may also be plated with a shiny metal such as gold or silver or chrome to match the overall look of the footwear or the removable upper or strap. The magnetic material is employed in this embodiment because the releasable fastener 8 shown in FIG. 3 in the engaged position, i.e., closed, is held in that position by a magnet or magnetized end portion of the releasable fastener 8. In FIG. 4, it is more clearly seen that the releasable fastener 8 is formed of two interlocking, slidably engaging barrels, where the outer barrel 14, shown here with surface ornamentation, has a hollow cylindrical interior that extends for substantially the length of the outer barrel 14. In the partially disengaged releasable fastener 8 of FIG. 4, it can be seen that an inner barrel 15 is a cylindrical pin, preferably solid, with an outer surface having a dimension (radius) less than the dimension (radius) of the inner surface of the hollow cylindrical interior of outer barrel 14. The outer barrel 14 has a slot extending substantially the length of the barrel 14 into which the [bar] slidably engages the outer barrel 14. The slidable engagement of the [bar] and the barrel 14 resists torsion from the flexing of the strap or the retainer 11, preserving the fastener 8 in a substantially rigid form. The inner barrel 15 is held in the engaged position with respect to outer barrel 14 by means of a magnet. The magnet may be located in the pin head 15*a* of inner barrel 15 or the left end 14*a* of outer barrel 14. Alternatively, the magnet may be located in the distal end 15*b* (FIG. 5) of inner barrel 15 or at the distal end 14*b* of outer barrel 14. To aid the magnet in holding the fastener 8 in the engaged position, it is preferable that the fastener 8 be angled downwardly where appropriate so that the inner barrel 15 is further held within the outer barrel 14 by the aid of gravity.

Figure 6:
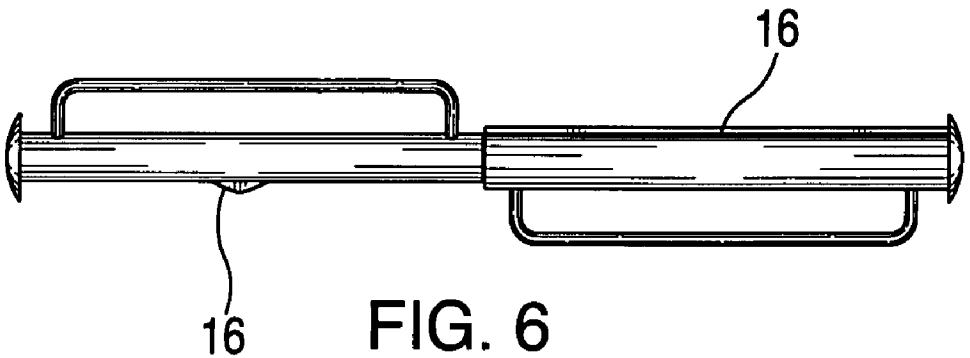
FIG. 6 is a view of an alternate form of securing the releasable fastener in an engaged position.

In place of a magnet, the releasable fastener 8 may be held in place with a biasing member 16 as shown in FIG. 6. The biasing member 16 exerts outward frictional force against the inner surface of the outer barrel 14. The releasable fastener 8 may also be held in place with a frictional fit either alone, with a magnet or with a biasing member for increased stability in the engaged position.

Figure 7:
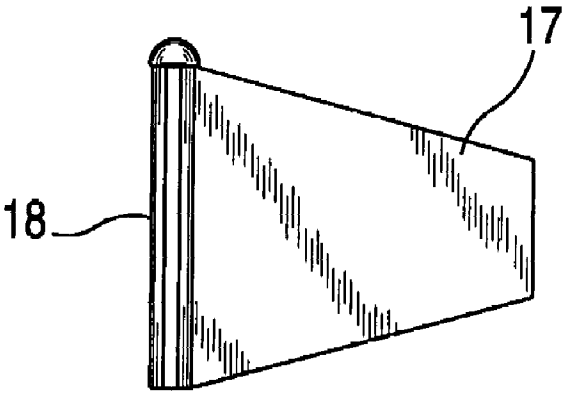
FIG. 7 is a view of an alternate form of securing the releasable fastener.
Figure 8:
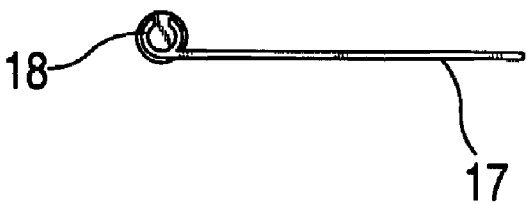
FIG. 8 is a side view of an alternate form of securing the releasable fastener of FIG. 7.
Figure 9:
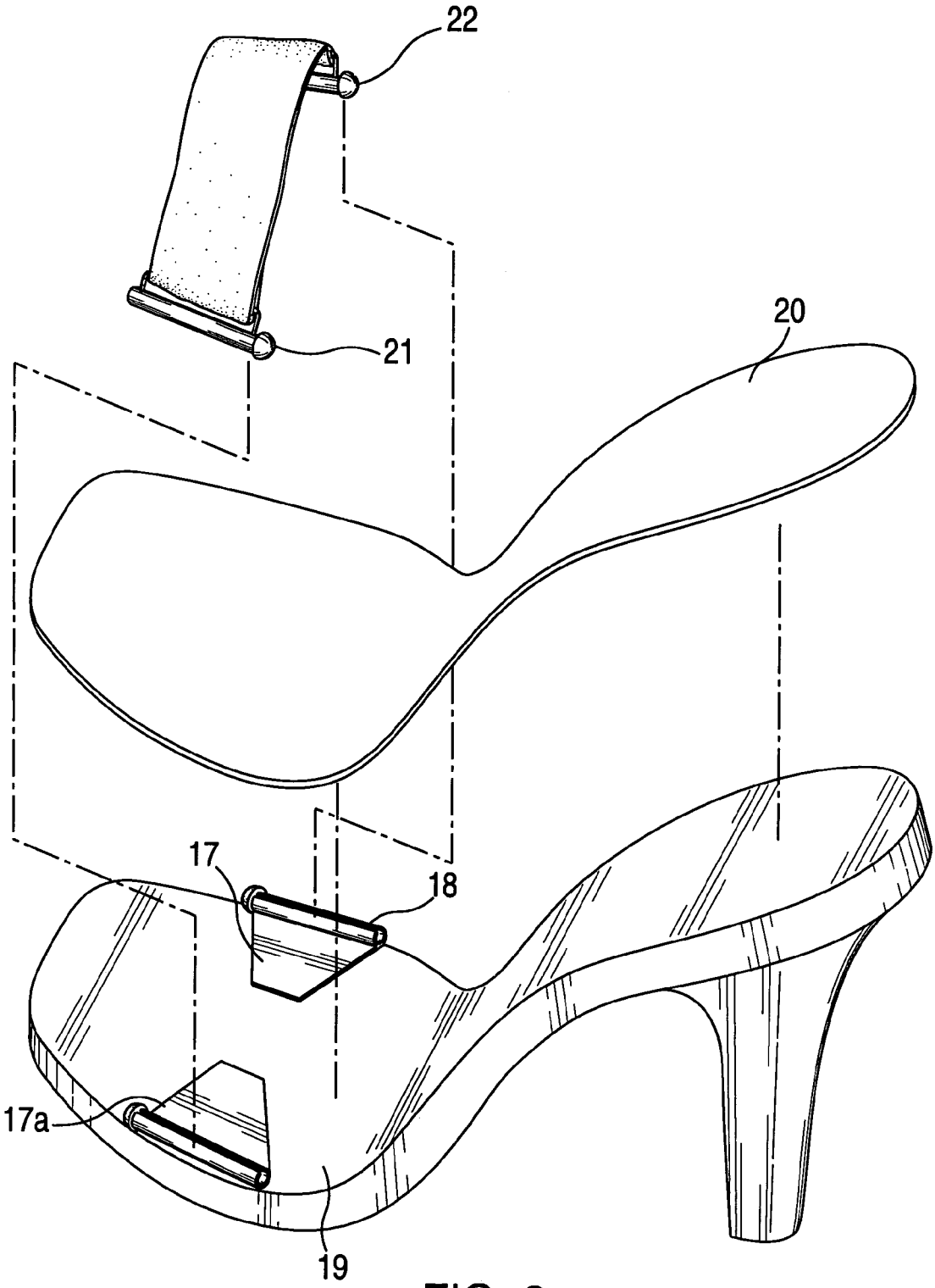
FIG. 9 is a view of the placement of the alternate form of securing the releasable fastener of FIG. 7.

FIG. 7 shows an alternative fastener for use with the present invention. Instead of a lower bar, the fastener employs a tab 17, preferably metal, and preferably made in whole or in part of a metal selected from the group consisting of titanium, steel and nickel. The tab 17 is secured to a barrel 18 for engagement with a mating barrel in the same way as outlined above with respect to the releasable fastener 8. The preferred method of securing the tab 17 to the barrel 18 is by welding or soldering. The length of the tab 17 is preferably about one inch. FIG. 8 shows a side view of the tab 17, having a preferable thickness of at least 1 millimeter. FIG. 9 shows the attachment of the tab 17 to the sole portion 19, preferably by the use of an adhesive. The insole portion 20 is secured to the sole 19 over the tab 17, covering the tab 17 but leaving the barrel 18 exposed so as to be engagable with a mating barrel 21 secured to strap 22. A matching tab 17*a* is shown in FIG. 9. In use, the weight of the user will also help keep the tab 17 in a secure engagement with the sole 19 when the footwear is in use.

Figure 10:
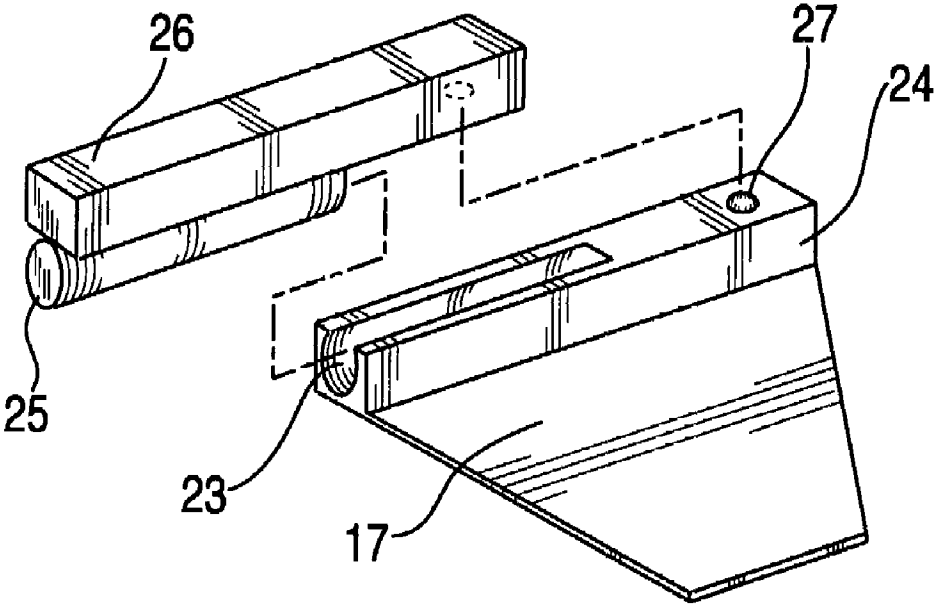

FIG. 10 shows an alternative means of employing the invention in a releasable fastener. The outer barrel 23 is a groove or channel cut into a piece of metal 24, with the corresponding inner barrel 25 being carried on a mating piece of metal 26. In the instant description, the biasing member 27 is a ball bearing which nests within a corresponding depression in the lower mating surface of the other metal piece 26 when in the engaged position in order to retain the outer barrel 23 and the inner barrel 25 in an engaged position. The releasable fastener is shown in FIG. 10 with the tab 17 attached to the metal piece 24 carrying the outer barrel 23 (the groove or channel). A slot may be cut through the metal piece 26 so that a strap (not shown) may be threaded through the slot to attach a shoe upper to the releasable fastener. Alternatively, a loop such as that shown by reference numeral 9 in FIG. 1 could be attached to one or both of the metal pieces 24 and 26.

Since other modifications or changes will be apparent to those skilled in the art, there have been described above the principles of this invention in connection with specific apparatus, it is to be clearly understood that this description is made only by way of example and not as a limitation to the scope of the invention.

What is claimed is:

1. An article of footwear comprising:

a sole portion;

an upper section having a left end portion and a right end portion;

a releasable fastener having an upper bar forming an upper loop and a lower bar forming a lower loop;

the releasable fastener having a securing mechanism;

the securing mechanism being a magnet;

the upper bar being carried on a substantially hollow outer barrel and the lower bar being carried on an inner barrel, a diameter of the inner barrel being less than a diameter of an inner surface of the outer barrel so that the inner barrel may be slidably engaged with the outer barrel and the inner barrel may be retained in an engaged position by the securing mechanism;

the left end portion of the upper section securable to the upper bar or the lower bar, and an upper end of a retainer secured to a remaining bar;

a lower end of the retainer being secured to the sole portion; and an end portion of the upper section being releasably secured to the sole portion by an engagement of the outer barrel and inner barrel.

2. The article of footwear of claim 1, wherein the lower end of the retainer is secured to the sole portion by placing the lower end beneath an insole and securing the lower end beneath the insole by an adhesive.

3. The article of footwear of claim 1, wherein the lower ends of the first and second retainers are secured to the sole portion by screws.

4. The article of footwear of claim 1, wherein the retainer is formed of a flexible material.

5. The article of footwear of claim 1, wherein the upper end of the retainer is secured to the releasable fastener by looping the upper end of the retainer around a bar to form a loop and stitching the loop closed about the bar.

6. The article of footwear of claim 1, wherein the upper section is a strap.

7. The article of footwear of claim 1, wherein the inner barrel and the outer barrel are substantially cylindrical in shape.

8. The article of footwear of claim 1, wherein the upper and lower bars each form a substantially rectangular shape.

9. The article of footwear of claim 1, wherein a barrel is made entirely or in part of a material selected from the group consisting of iron, steel or any other magnetic metal.

10. The article of footwear of claim 1, wherein a barrel is made entirely or in part of a material selected from the group consisting of titanium, steel, silver, brass or nickel.

11. An article of footwear comprising:

a sole portion;

an upper section having a left end portion and a right end portion;

a releasable fastener having an upper bar forming an upper loop and a lower bar forming a lower loop;

the releasable fastener having a securing mechanism, the securing mechanism being a biasing member;

the upper bar being cried on a substantially hollow outer barrel and the lower bar being carried on an inner barrel, a diameter of the inner barrel being less than a diameter of an inner surface of the outer barrel so that the inner barrel may be slidably engaged with the outer barrel and the inner barrel may be retained in an engaged position by the securing mechanism;

the left end portion of the upper section securable to the upper bar or the lower bar, and an upper end of a retainer secured to a remaining bar;

a lower end of the retainer being secured to the sole portion; and an end portion of the upper section being releasably secured to the sole portion by an engagement of the outer barrel and inner barrel.

12. The article of footwear of claim 11, wherein the lower end of the retainer is secured to the sole portion by placing the lower end beneath an insole and securing the lower end beneath the insole by an adhesive.

13. The article of footwear of claim 11, wherein the lower ends of the first and second retainers are secured to the sole portion by screws.

14. The article of footwear of claim 11, wherein the retainer is formed of a flexible material.

15. The article of footwear of claim 11, wherein the upper end of the retainer is secured to the releasable fastener by looping the upper end of the retainer around a bar to form a loop and stitching the loop closed about the bar.

16. The article of footwear of claim 11, wherein the upper section is a strap.

17. The article of footwear of claim 11, wherein the inner barrel and the outer barrel are substantially cylindrical in shape.

18. The article of footwear of claim 11, wherein the upper and lower bars each form a substantially rectangular shape.

19. The article of footwear of claim 11, wherein a barrel is made entirely or in part of a material selected from the group consisting of titanium, steel, silver, brass or nickel.

* * * * *